US009315348B2

(12) United States Patent
Wakakusa

(10) Patent No.: US 9,315,348 B2
(45) Date of Patent: Apr. 19, 2016

(54) SHEET CONVEYOR DEVICE AND IMAGE RECORDING DEVICE

(71) Applicant: BROTHER KOGYO KABUSHIKI KAISHA, Nagoya-shi, Aichi-ken (JP)

(72) Inventor: Keisuke Wakakusa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/227,814

(22) Filed: Mar. 27, 2014

(65) Prior Publication Data

US 2015/0091241 A1 Apr. 2, 2015

(30) Foreign Application Priority Data

Sep. 27, 2013 (JP) ..... 2013-202309

(51) Int. Cl.

| | |
|---|---|
| ***B65H 3/44*** | (2006.01) |
| ***G03G 21/16*** | (2006.01) |
| ***B65H 1/04*** | (2006.01) |
| ***B65H 1/28*** | (2006.01) |

(52) U.S. Cl.

CPC ..... *B65H 3/446* (2013.01); *B65H 1/04* (2013.01); *B65H 1/28* (2013.01); *B65H 3/44* (2013.01); *G03G 21/1638* (2013.01); *B65H 2402/441* (2013.01); *B65H 2402/63* (2013.01); *B65H 2403/41* (2013.01); *B65H 2405/324* (2013.01); *B65H 2407/21* (2013.01); *B65H 2511/10* (2013.01); *B65H 2801/39* (2013.01); *G03G 2221/169* (2013.01); *G03G 2221/1687* (2013.01)

(58) Field of Classification Search

CPC ..... B65H 2402/31; B65H 2402/35; B65H 2402/441; B65H 2402/442; B65H 2402/45; B65H 2407/21; G03G 21/1623; G03G 21/1628; G03G 21/1633; G03G 21/1638; G03G 2221/1687; G03G 2221/169

USPC ..... 271/9.09, 162; 399/124, 125, 392

See application file for complete search history.

(56) References Cited

U.S. PATENT DOCUMENTS

| | | | | |
|---|---|---|---|---|
| 7,364,149 | B2 * | 4/2008 | Terao et al. | 270/58.13 |
| 8,204,401 | B2 * | 6/2012 | Tsuchiya | 399/107 |
| 2008/0290590 | A1 * | 11/2008 | Mizuguchi | 271/207 |
| 2009/0175648 | A1 * | 7/2009 | Tsuchiya | 399/107 |
| 2011/0262178 | A1 * | 10/2011 | Tsuchiya | 399/98 |
| 2012/0141158 | A1 * | 6/2012 | Yamauchi | 399/110 |

FOREIGN PATENT DOCUMENTS

| | | | |
|---|---|---|---|
| JP | 2004-2224463 | A | 8/2004 |
| JP | 2011-219201 | A | 11/2011 |
| JP | 2012-001329 | A | 1/2012 |

* cited by examiner

*Primary Examiner* — Patrick Cicchino

(74) *Attorney, Agent, or Firm* — Merchant & Gould P.C.

(57) ABSTRACT

A sheet conveyor device includes a first housing having a sheet conveyance path. A second housing is pivotably disposed above the first housing and movable between a first position at which the second housing is adjacent to an upper side of the first housing and a second position at which the second housing is angled relative to the upper side of the first housing. A sheet support member is connected to the first housing and has a sheet inlet communicating with the conveyance path. An interlock mechanism is pivotable about a second rotational axis that is parallel to the first rotational axis in response to movement of the second housing between the first position and the second position to move a cover between a first state and a second state.

18 Claims, 12 Drawing Sheets

SHEET CONVEYOR DEVICE AND IMAGE RECORDING DEVICE

CROSS-REFERENCE TO RELATED APPLICATION

This application claims priority from Japanese Patent Application No. 2013-202309, filed on Sep. 27, 2013, which is incorporated herein by reference in its entirety.

TECHNICAL FIELD

Aspects described herein generally relate to a sheet conveyor device configured to convey a sheet along a conveyance path and an image recording device including the sheet conveyor device.

BACKGROUND

An example image recording device has a conveyance path defined inside its housing and is configured to record an image onto a sheet that is being conveyed along the conveyance path. Some image recording devices include a sheet cassette configured to support one or more sheets. Some of the image recording devices include a manual feed tray configured to guide a sheet into the conveyance path, in addition to the sheet cassette.

There are image recording devices in which a portion of its housing is configured to be opened and closed in order to perform maintenance of the image recording device or in order to clear a paper jam, or that are embodied in the form of multifunction devices having a scanning function. In such image recording devices, a document cover of a flatbed scanner is configured to be opened and closed.

The image recording devices include an openable cover that covers a sheet inlet, which is an opening for allowing one or more sheets to enter therein, to prevent an entry of foreign matter and/or dust via the sheet inlet.

SUMMARY

In accordance with certain aspects of the disclosure, a sheet conveyor device includes a first housing having a sheet conveyance path. A second housing is pivotably disposed above the first housing and movable between a first position at which the second housing is adjacent to an upper side of the first housing and a second position at which the second housing is angled relative to the upper side of the first housing. A sheet support member is connected to the first housing and has a sheet inlet communicating with the conveyance path. A cover is disposed on the sheet support member to pivot about a first rotational axis between a first state and a second state. An interlock mechanism is pivotable about a second rotational axis that is parallel to the first rotational axis in response to movement of the second housing between the first position and the second position to move the cover between the first state and the second state. In some embodiments, the interlock mechanism contacts the second housing and the cover to move the cover between the first state and the second state in response to movement of the second housing between the first position and the second position.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
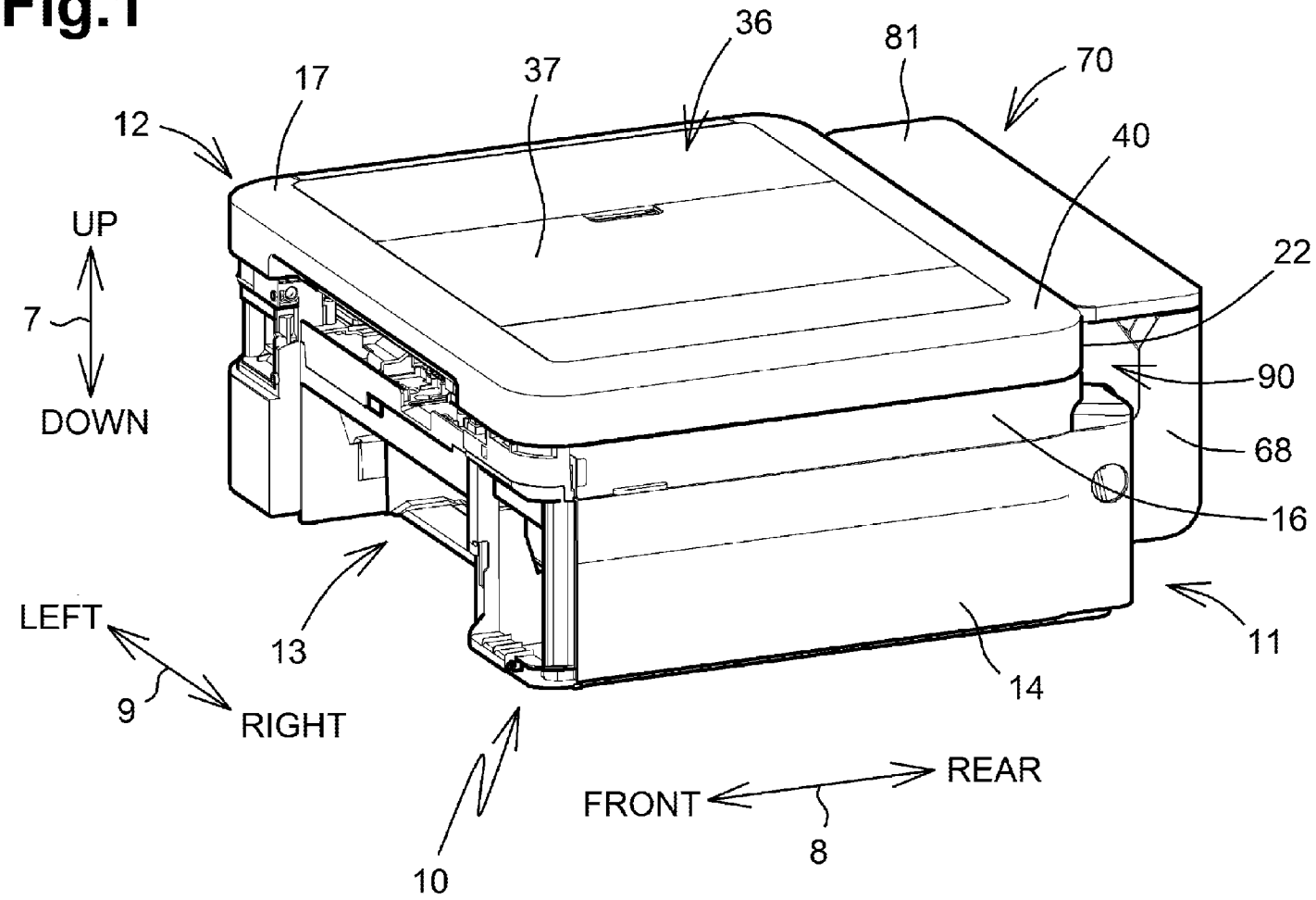
FIG. 1 is a perspective view depicting a multifunction device in an illustrative embodiment according to one or more aspects of the disclosure, wherein a document cover is located at a first position.

In the following detailed description, reference is made to the accompanying drawings which form a part hereof, and in which is shown by way of illustration specific examples. In this regard, directional terminology, such as "up," "down," "front," "rear," etc., is used with reference to the orientation of the Figure(s) being described. Because the various components can be positioned in a number of different orientations, the directional terminology is used for purposes of illustration and is in no way limiting. It is to be understood that other versions may be utilized and structural or logical changes may be made without departing from the scope of the present invention. The following detailed description, therefore, is not to be taken in a limiting sense. It is to be understood that features of the various examples described herein may be combined with each other, unless specifically noted otherwise.

Hereinafter, a multifunction device 10 according to an illustrative embodiment of the disclosure will be described. The illustrative embodiment described below is merely an example. Various changes, arrangements and modifications may be applied therein without departing from the spirit and scope of the disclosure.

In the description below, an up-down direction 7 is defined with reference to an orientation of the multifunction device 10 (as an example of an image recording device) that is disposed in which it is intended to be used (e.g., an orientation depicted in FIG. 1). A side of the multifunction device 10, in which an opening 13 is defined, is defined as the front of the multifunction device 10. A front-rear direction 8 is defined with reference to the front of the multifunction device 10. A right-left direction 9 is defined with respect to the multifunction device 10 as viewed from its front.

In some image recording devices, a cover may be required to be disposed out of a pivotable range of the housing and a pivotable range of the document cover to avoid interference of the openable housing and the openable document cover with the cover configured to expose and close the sheet inlet. This configuration, however, may cause an increase in size of the image recording devices.

[Overall Configuration of Multifunction Device 10]

FIG. 1 an example of multifunction device in accordance with aspects of the present disclosure. The example multifunction device 10 has substantially a rectangular-parallelepiped shape. The multifunction device 10 includes a printer unit 11 configured to record an image onto a sheet, for example, a recording sheet, using an inkjet recording method. The multifunction device 10 has various functions, for example, a facsimile function and a printing function. The printer unit 11 corresponds to the image recording device.

The printer unit 11 includes a housing 14 having a sheet conveyance path 65 therein. The housing 14 has the opening 13 defined in its front. A feed tray 20 and a discharge tray 21 are configured to support thereon one or more recording sheets having various sizes and to be inserted into and removed from the printer unit 11 via the opening 13 in the front-rear direction 8. FIGS. 1, 2, 3, 5, and 7 each depict the multifunction device 10 in which the feed tray 20 and the discharge tray 21 are removed from the housing 14.

Figure 6:
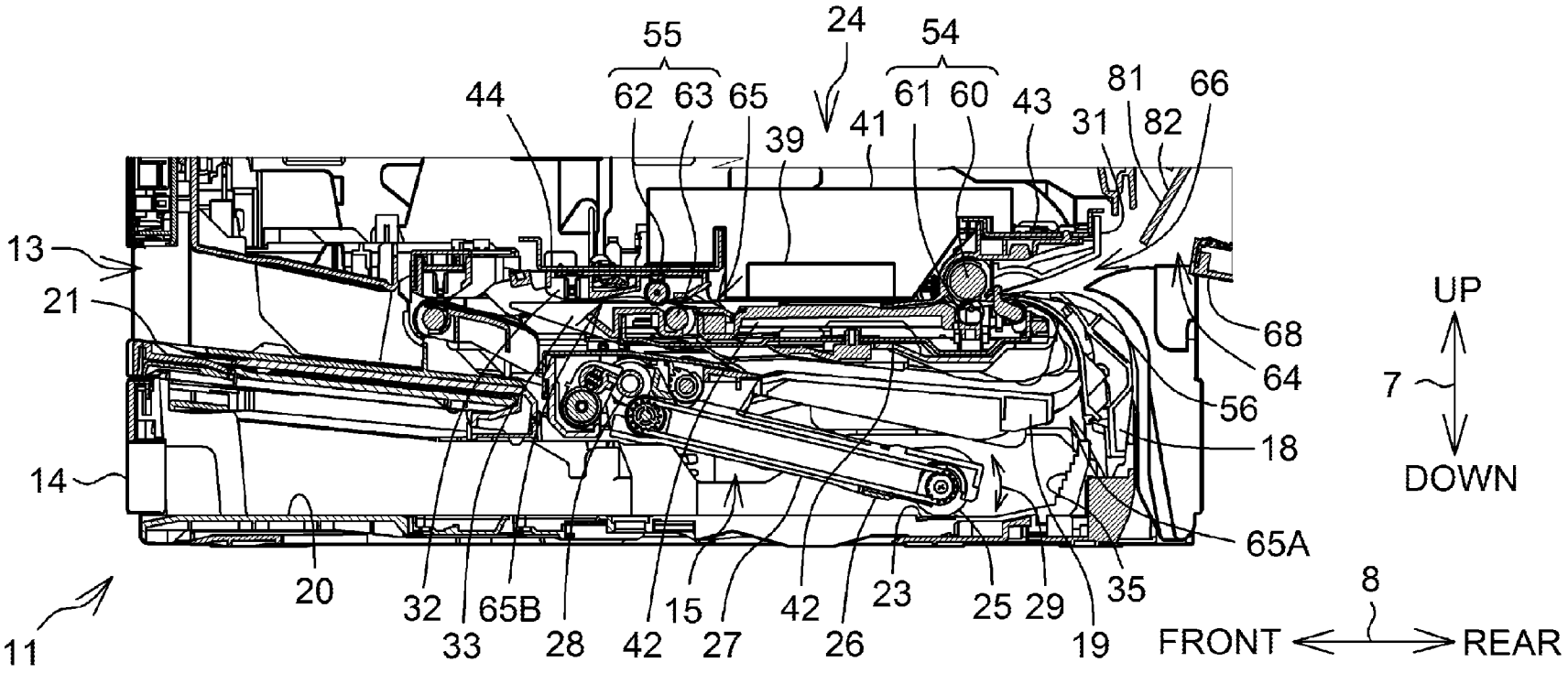
FIG. 6 is a sectional view depicting an internal configuration of a printer unit in the illustrative embodiment according to one or more aspects of the disclosure.

As depicted in FIG. 6, an example of the printer unit 11 includes a feeding section 15, a recording section 24, a first conveyor roller pair 54, and a second conveyor roller pair 55. The feeding section 15 is configured to feed one or more recording sheets from the feed tray 20. The recording section 24 is configured to record an image onto the fed recording sheet. The feeding section 15, the first conveyor roller pair 54, the second conveyor roller pair 55, the feed tray 20, a bypass tray 70, a scanner unit 12, except the recording section 24, constitutes a sheet conveyor device to convey a sheet along the sheet conveyance path.

As depicted in FIG. 1, an example scanner unit 12 is disposed above the printer unit 11. The scanner unit 12 includes a housing 16. The housing 16 of the scanner unit 12 has the same dimensions as the housing 14 of the printer unit 11 in the front-rear direction 8 and the right-left direction 9. The housing 14 of the printer unit 11 and the housing 16 of the scanner unit 12 may define substantially a rectangular-parallelepiped outline of the multifunction device 10 while the scanner unit 12 is disposed above the printer unit 11. The housing 16 may is coupled on the housing 14 and is configured to be pivot on a rotational axis that extends along the right-left direction 9 and is located at the back of the housing 14. The housing 14 and the housing 16 together are sometimes referred to herein as a first housing.

Figure 4:
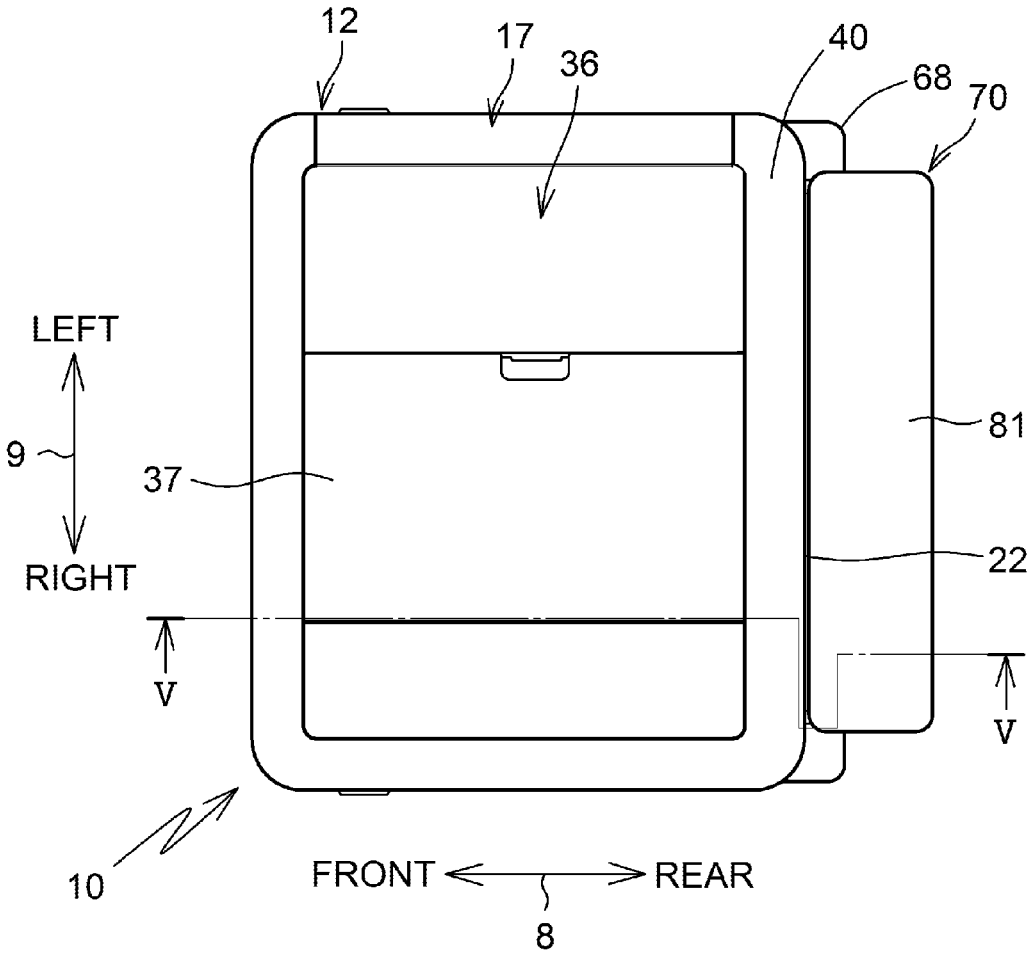
FIG. 4 is a plan view depicting the multifunction device in the illustrative embodiment according to one or more aspects of the disclosure, wherein the document cover is located at the first position.
Figure 5:
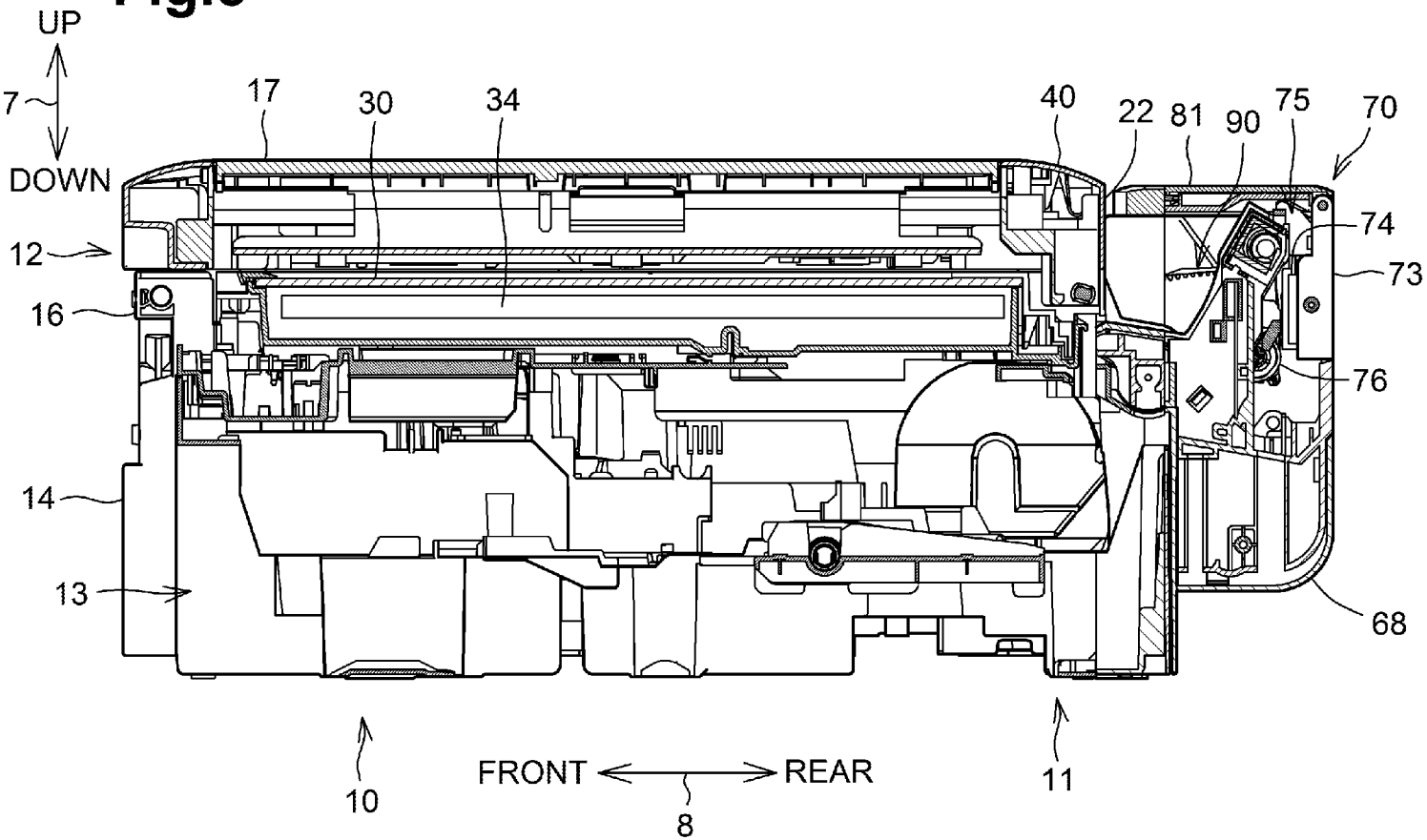
FIG. 5 is a sectional view taken along line V-V of FIG. 4 in the illustrative embodiment according to one or more aspects of the disclosure.

As depicted in the example illustrated in FIG. 5, the scanner unit 12 includes a flatbed scanner. An image sensor 34 is disposed inside the housing 16. The image sensor 34 is configured to read an image optically from a document. A platen glass 30 is disposed at a top of the housing 16 and is configured to support a document thereon. The platen glass 30 is covered with a second housing, which in the illustrated embodiment is a document cover 17. FIGS. 1, 3, 4, 5, 7, and 9 each depict the multifunction device 10 in which the second housing 17 is in a first position adjacent to an upper surface of the first housing 14, 16 wherein the platen glass 30 is covered with the document cover 17, and FIGS. 2, 8, and 10 each depict the multifunction device 10 in a second position in which the second housing 17 is angled relative to the upper surface of the first housing 14,16 such that the platen glass 30 is exposed.

Figure 2:
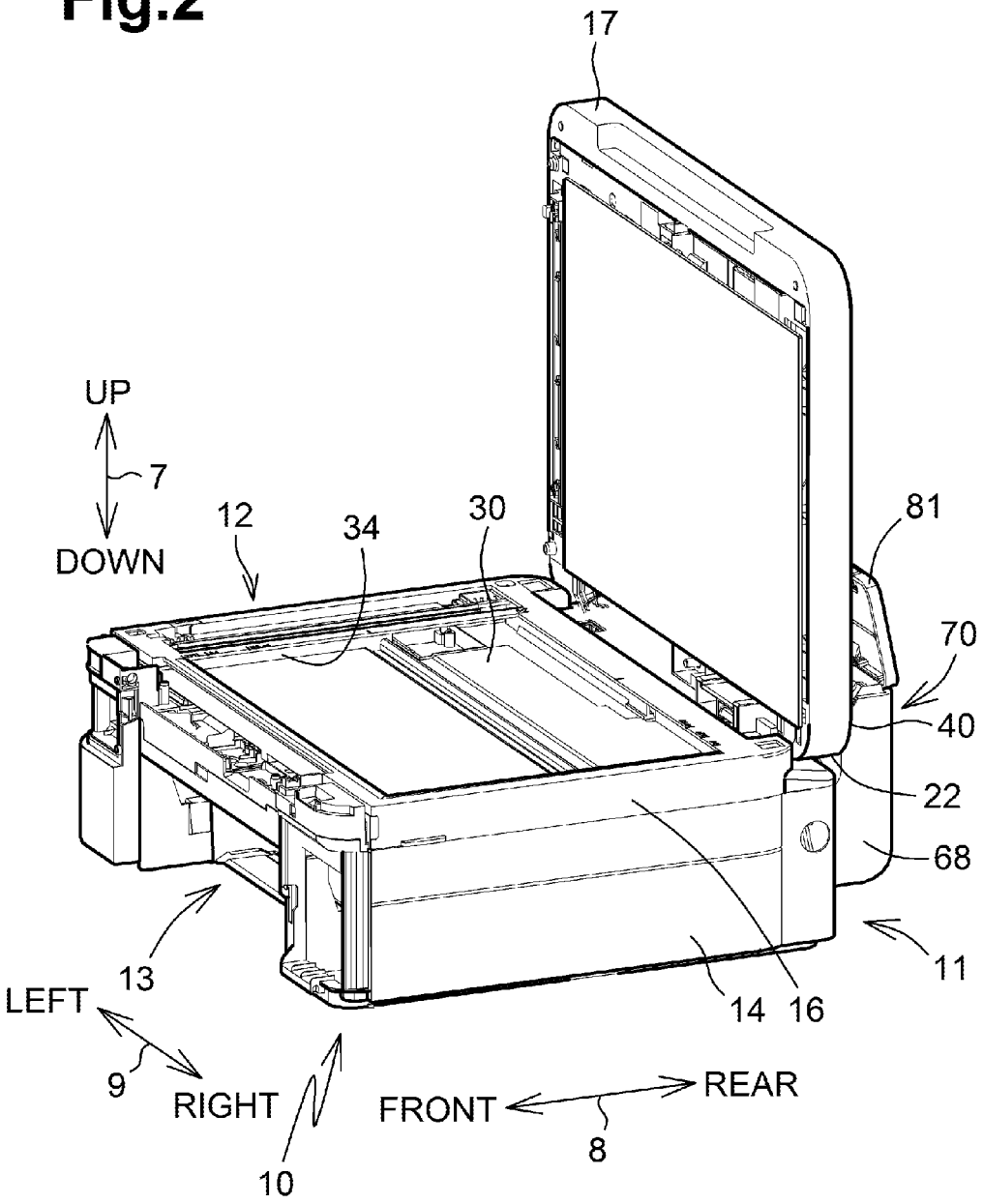
FIG. 2 is a perspective view depicting the multifunction device in the illustrative embodiment according to one or more aspects of the disclosure, wherein the document cover is located at a second position.

The document cover 17 is coupled on the back of the first housing 14, 16 and is configured to pivot on its rotational axis extending along the right-left direction 9. As depicted in FIG. 1, the document cover 17 is configured so as to be movable between the first position and the second position. In the first position, the document cover 17 may contact the upper surface of the housing 16 so as to keep the document cover 17 covering the platen glass 30. As the forward portion of the document cover 17 moves upward from the state depicted in FIG. 1, the document cover 17 pivots and thus is exposed (e.g., a second position) as depicted in FIG. 2. That is, the document cover 17 at the first position is located at a position closest to the housing 16 and the document cover 17 at the second position is located at a position farthest from the housing 16. The document cover 17 corresponds to a second housing.

The document cover 17 includes an automatic document feeder ("ADF") 36. The ADF 36 is configured to pick up, one by one, one or more documents of which images are to be read, and to convey the picked document. The ADF 36 has a known internal configuration, and therefore, a detailed description of the ADF 36 will be omitted. The ADF 36 is configured to convey, one by one, one or more sheet-like documents placed on the document tray 37, using, for example, a pickup roller and a feed roller, onto the platen glass 30 and to discharge the one or more documents onto a discharge tray 38.

Figure 8:
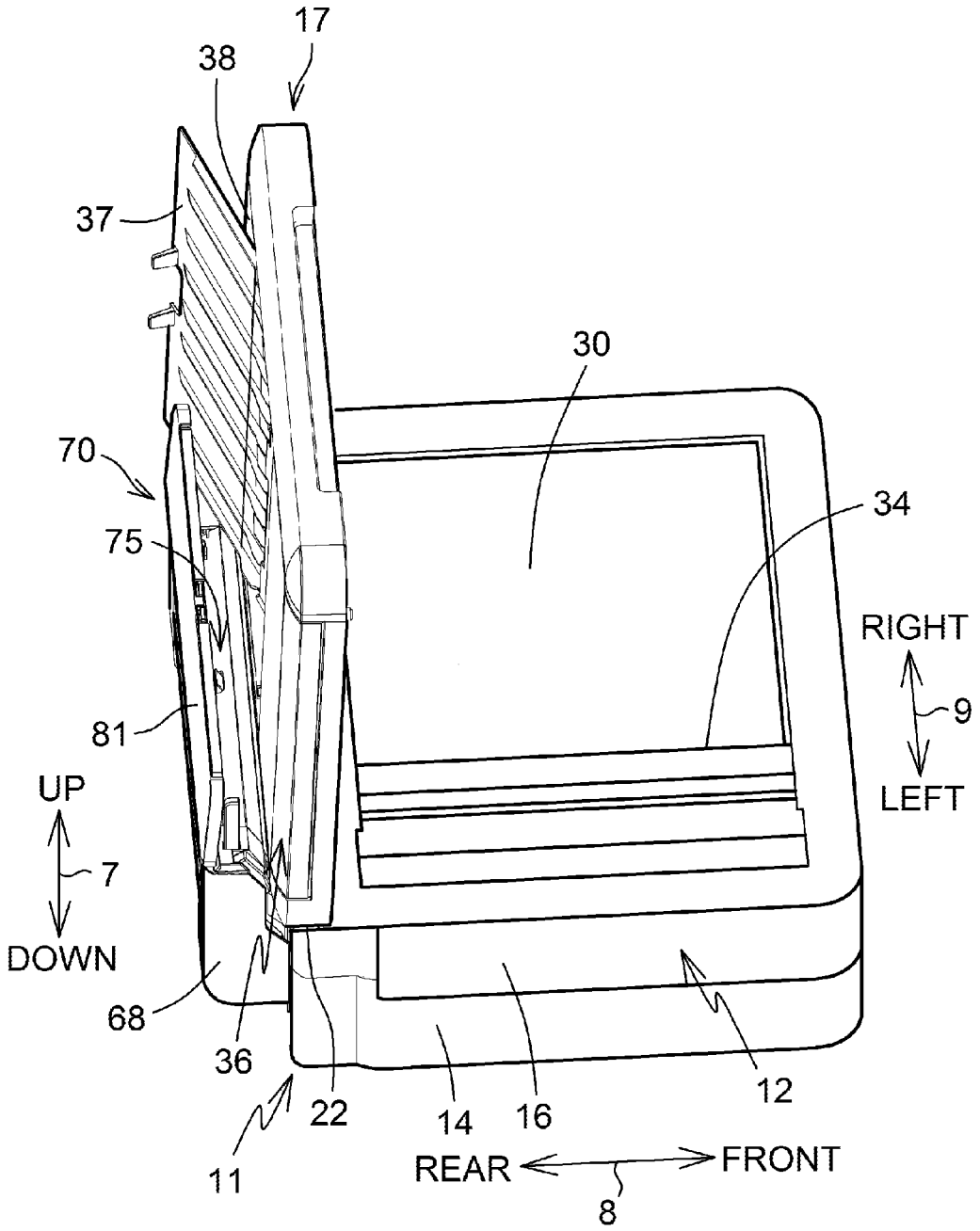
FIG. 8 is a perspective view depicting the multifunction device in the illustrative embodiment according to one or more aspects of the disclosure, wherein the document tray is in a protruding state and the document cover is located at the second position.

The document tray 37 is pivotably disposed at the document cover 17. A rotational axis of the document cover 17 extends along the front-rear direction 8. As depicted in FIG. 1, while the ADF 36 is not used, the document tray 37 is in a lying position in which the document tray 67 lies to constitute a portion of an upper surface of the document cover 17. To use the ADF 36, as depicted in FIG. 8, the document tray 37 is pivoted to a protruding position in which the document tray 37 protrudes obliquely upward from the document cover 17. The document tray 37 at the protruding position protrudes upward to the right when viewed from the front of the multifunction device 10. As the document tray 37 moves to the protruding position, the discharge tray 38 appears below the document tray 37. FIG. 8 depicts the multifunction device 10 with the document cover 17 being opened. When the ADF 36 is used, the document cover 17 is closed, that is, is located at the first position, as depicted in FIG. 1.

[Printer Unit 11]

Hereinafter, an example configuration of the printer unit 11 will be described.

[Feed Tray 20]

As depicted in FIG. 6, the feed tray 20 has outline dimensions in the front-rear direction 8 and in the right-left direction 9 that are longer than its outline dimension in the up-down direction 7. The feed tray 20 has a box-like shape with an open top. The discharge tray 21 is disposed above the feed tray 20. The feed tray 20 is configured to support one or more recording sheets having various sizes, for example, an A4 size specified in the Japanese Industrial Standard. The feed tray 20 is positioned in an internal space that is in communication with the opening 13 in the housing 14. The feed tray 20 is configured to move back and forth along the front-rear direction 8 through the opening 13 with respect to the housing 14.

[Feeding Section 15]

As depicted in FIG. 6, the illustrated feeding section 15 includes a feed roller 25, a feed arm 26, a power transmission mechanism 27, and a separation pad 23. The feeding section 15 is disposed above the feed tray 20 and below the recording section 24. The feed roller 25 is swingably supported at a distal end portion of the feed arm 26*t*. A shaft 28 is disposed at a proximal end portion of the feed arm 26. The feed arm 26 is swingable on the shaft 28 in directions indicated by an arrow 29. This configuration enables the feed roller 25 to come into contact with and move away from a bottom surface the feed tray 20 or one or more recording sheets supported by the feed tray 20. The separation pad 23 is disposed on the bottom surface of the feed tray 20 with facing the feed roller 25. The separation pad 23 has a frictional coefficient greater than a frictional coefficient of the bottom surface of the feed tray 20, with respect to a recording sheet.

In some examples, a motor (not depicted) provides a motor force that is transmitted to the feed roller 25 via the power transmission mechanism 27. The power transmission mechanism 27 transmits rotation transmitted to the shaft 28 to a shaft of the feed roller 25 via an endless belt. As the feed roller 25 rotates while the feed roller 25 is in contact with an uppermost recording sheet of the one or more recording sheets placed on the bottom surface of the feed tray 20, the uppermost recording sheet is fed into a conveyance path 65. During the feeding of the recording sheet into the conveyance path 65, a leading edge of the recording sheet may come into contact with a separation member 35 disposed behind the feed tray 20 in the front-rear direction 8. Thus, one or more subsequent recording sheets stay in the feed tray 20 without being dragged by the uppermost recording sheet. A lowermost recording sheet is not dragged by a recording sheet immediately above the lowermost recording sheet due to a frictional force caused between the lowermost recording sheet and the separation pad 23 when the recording sheet immediately above is fed.

[Conveyance Path 65]

FIG. 6 further illustrates an example of the conveyance path 65 defined in an internal space in the housing 14. The conveyance path 65 extends upward from a rear end of the feed tray 20. Then, the conveyance path 65 is curved to have a U-turn shape. The conveyance path 65 is curved toward the front from behind the printer unit 11 and further extends to the discharge tray 21 straight. The conveyance path 65 includes a U-turn shaped curved path 65A and a straight path 65B mainly.

The curved path 65A is defined by an outer guide member 18, an inner guide member 19, and a guide member 31. The outer guide member 18 and a portion of the guide member 31 face the inner guide member 18 with spaced to leave therebetween clearance for allowing a recording sheet to pass therethrough. The straight path 65B is defined by a recording section 24, a platen 42, a guide member 32, and a guide member 33. The recording section 24 and the platen 42 face each other and are spaced apart from each other to leave therebetween clearance for allowing a recording sheet to pass therethrough. The guide member 32 and the guide member 33 also face each other and are spaced apart from each other to leave therebetween clearance for allowing a recording sheet to pass therethrough.

The recording sheet fed into the conveyance path 65 by the feed roller 25 in the feed tray 20 is guided into the curved path 65A and is conveyed upward from below. Through the conveyance in the curved path 65A, a conveyance direction of the recording sheet is reversed. The recording sheet is then further guided into the straight path 65B and is conveyed toward the front from the rear while the current conveyance direction is maintained.

In the illustrative embodiment, the guide members 18, 19, 31, 32, and 33 each may have a guide surface including a single surface or a guide surface including a group of end surfaces of ribs.

The guide member 31 is disposed immediately upstream of (behind) the first conveyor roller pair 54 and above the inner guide member 19. The outer guide member 18 and the guide member 31 also defines a bypass 66.

[First Conveyor Roller Pair 54 and Second Conveyor Roller Pair 55]

As depicted in FIG. 6, the first conveyor roller pair 54 is disposed upstream of the recording section 24 in the conveyance path 65 with respect to the conveyance direction (e.g., the forward direction in the front-rear direction 8). The first conveyor roller pair 54 includes a first conveyor roller 60 and a pinch roller 61. The second conveyor roller pair 55 is disposed downstream of the recording section 24 in the conveyance path 65 with respect to the conveyance direction. The second conveyor roller pair 55 includes a second conveyor roller 62 and a spur 63. The first conveyor roller 60 and the second conveyor roller 62 rotate by transmission of rotation of the motor (not depicted). The first conveyor roller pair 54 and the second conveyor roller pair 55 convey a recording sheet by rotation of the first conveyor roller 60 and the second conveyor roller 62 in the respective pairs 54 and 55 while the first conveyor roller pair 54 pinches the recording sheet between the rollers 60 and 61 and the second conveyor roller pair 55 pinches the recording sheet between the rollers 62 and 63. The first conveyor roller pair 54 and the second conveyor roller pair 55 correspond to a conveyor portion.

[Recording Section 24]

As depicted in FIG. 6, the example recording section 24 is disposed between the first conveyor roller pair 54 and the second conveyor roller pair 55. The recording section 24 is disposed above the platen 42 with facing the platen 42. The recording section 24 includes a carriage 41 and a recording head 39. The carriage 41 is supported by guide rails 43 and 44 that are disposed in back of and in front of the platen 42, respectively. The guide rail 44 is equipped with a known belt mechanism. The carriage 41 is coupled on an endless belt of the belt mechanism. With rotation of the endless belt, the carriage 41 moves along the guide rails 43 and 44 in the right-left direction 9.

The recording head 39 is disposed on the carriage 41. The recording head 39 has a plurality of nozzles (not depicted) in its lower surface. The recording head 39 is supplied with ink from one or more ink cartridges (not depicted). The recording head 39 is configured to eject ink from the nozzles selectively in the form of fine ink droplets. While the carriage 41 reciprocates in the right-left direction 9, the recording head 39 ejects ink droplets selectively from the nozzles onto a recording sheet supported by the platen 42. The ejected ink droplets adhere to the recording sheet on the platen 42, whereby an image is recorded on the recording sheet.

[Bypass 66]

As depicted in FIG. 6, the housing 14 has an opening 64 in the back thereof. The housing 14 further has the bypass 66 defined therein. The bypass 66 extends from the opening 64 to the first conveyor roller pair 54. The bypass 66 extends obliquely downward to the front from the rear in the front-rear direction 8. The bypass 66 is defined by the guide member 31 and the outer guide member 18 disposed below the guide member 31. The curved path 65A and the straight path 65B in the conveyance path 65 are defined at a position lower than the bypass 66.

A recording sheet placed on a bypass tray 70 is guided obliquely downward through the bypass 66 to enter the straight path 65B of the conveyance path 65. Then, an image is recorded in the recording section 24 while the recording sheet is conveyed by the first conveyor roller pair 54. Thereafter, the recording sheet is discharged onto the discharge tray 21. As described above, the recording sheet placed on the bypass tray 70 is conveyed in substantially a straight path.

[Bypass Tray 70]

FIGS. 1 and 5 further illustrate an example of the bypass tray 70 that is connected to the first housing 14,16 and communicates with the conveyance path 65. As depicted in the embodiment shown in FIGS. 1 and 5, the bypass tray 70 is disposed at the back of the multifunction device 10. The bypass tray 70 is configured to support one or more recording sheets in a manner independent of the feed tray 20. The bypass tray 70 corresponds to a sheet support member.

A fixed portion 68 is disposed behind the housing 16 of the scanner unit 12 to cover the opening 64 (see FIG. 6). The fixed portion 68 constitutes a downstream portion of the bypass tray 70 in the conveyance direction. A support plate 73 is pivotably disposed in the back of the fixed portion 68. The fixed portion 68 and the support plate 73 constitute the bypass tray 70.

The support plate 73 is pivotably supported by the fixed portion 68 at a lower end portion of the support plate 73. As depicted in FIG. 1, while the bypass tray 70 is not used, the support plate 73 is located at a position closer to the rear surface of the housing 14 in a standing manner in the bypass tray 70 (e.g., a first state). While the bypass tray 70 is used, the support plate 73 is located at a position distant from the rear surface of the housing 14 in a tilting manner in which an upper end of the support plate 73 points toward the rear. That is, the support plate 73 in the tilting position tilts toward the rear than the support plate 73 in the first state.

Figure 3:
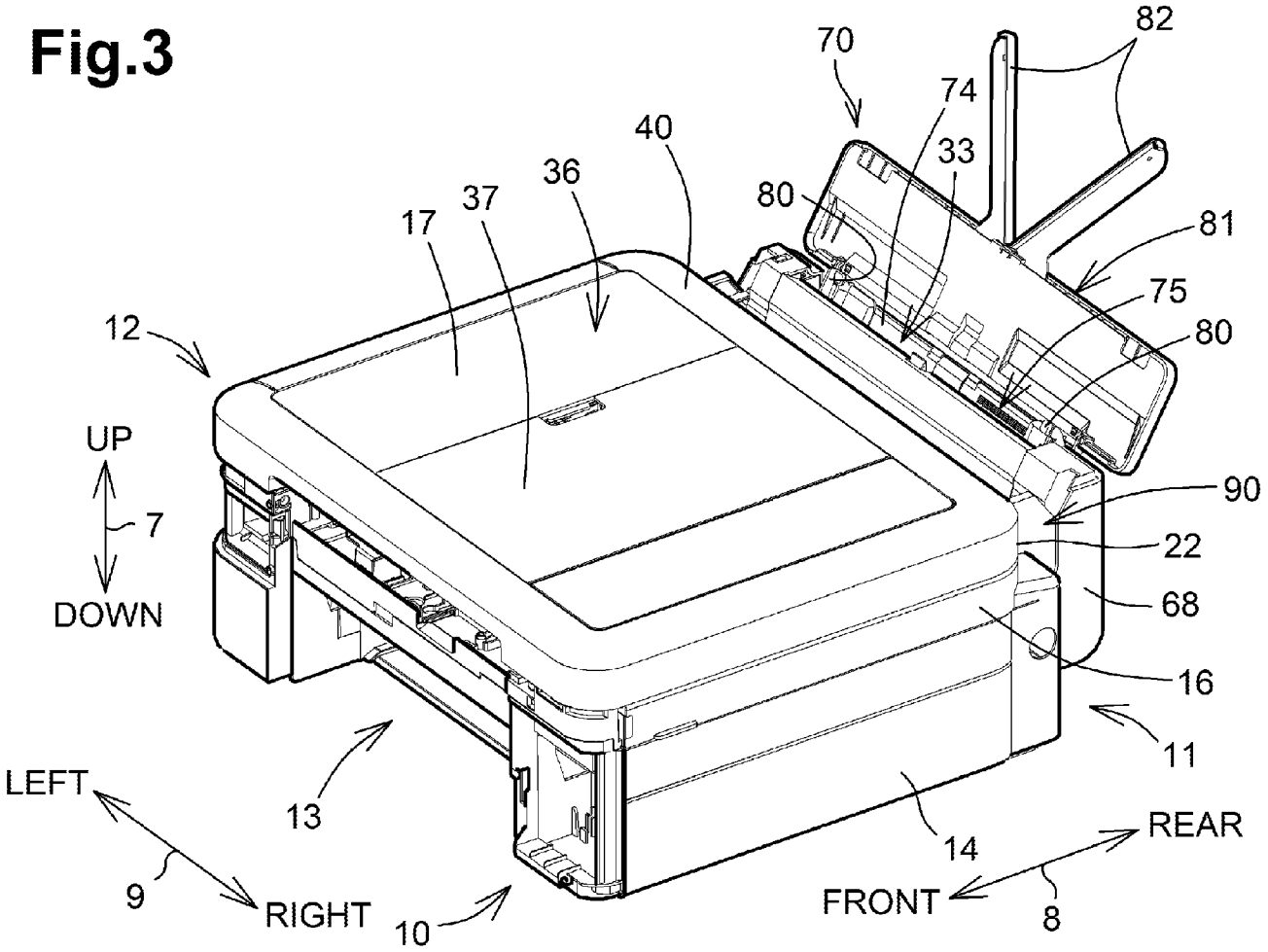
FIG. 3 is a perspective view depicting the multifunction device in the illustrative embodiment according to one or more aspects of the disclosure, wherein a bypass tray is in a used state.

As depicted in FIG. 3, side guides 80 are disposed on a support surface 74 that is a front surface of the support plate 73. Each side guide 80 includes a guide surface that may extend along the conveyance direction that a recording sheet is conveyed on the bypass tray 70. The guide surfaces of the side guides 80 support side edges of one or more recording sheets supported by the support surface 74 to allow the one or more recording sheets to move along the guide surfaces in the conveyance direction. A distance between the side guides 80 in the right-left direction 9 is variable. Therefore, the side guides 80 are configured to support side edges of recording sheets having various sizes supported by the support surface 74 to allow the recording sheets to move along the guide surfaces of the side guides 80.

The fixed portion 68 includes a feed roller 76 facing the support surface 74. The feed roller 76 is configured to rotate by transmission of a driving force from a motor (not depicted). Although not depicted in the drawings, the feed roller 76 is supported by an arm that is pivotable in directions that the feed roller 76 comes into contact with or moves away from the support surface 74. This configuration enables the feed roller 76 to move in the directions that the feed roller 76 comes into contact with or moves away from the support surface 74 in accordance with the number of sheets or the thickness of one or more sheets supported by the support surface 74. As the feed roller 76 rotates while the feed roller 76 is in contact with an uppermost recording sheet of one or more recording sheets supported by the support surface 74 of the bypass tray 70, the uppermost recording sheet is fed into the bypass 66.

A tray cover 81 is disposed at an upper end portion of the support plate 73. The tray cover 81 is configured to pivot with respect to the support plate 73 about a rotational axis. The tray cover 81 has a flat plate shape and is configured to close a sheet inlet 75 defined in an upper end portion of the bypass tray 70. The rotational axis of the tray cover 81 extends parallel to the rotational axis of the document cover 17. That is, the rotational axis of the tray cover 81 extends along the right-left direction 9.

Figure 9:
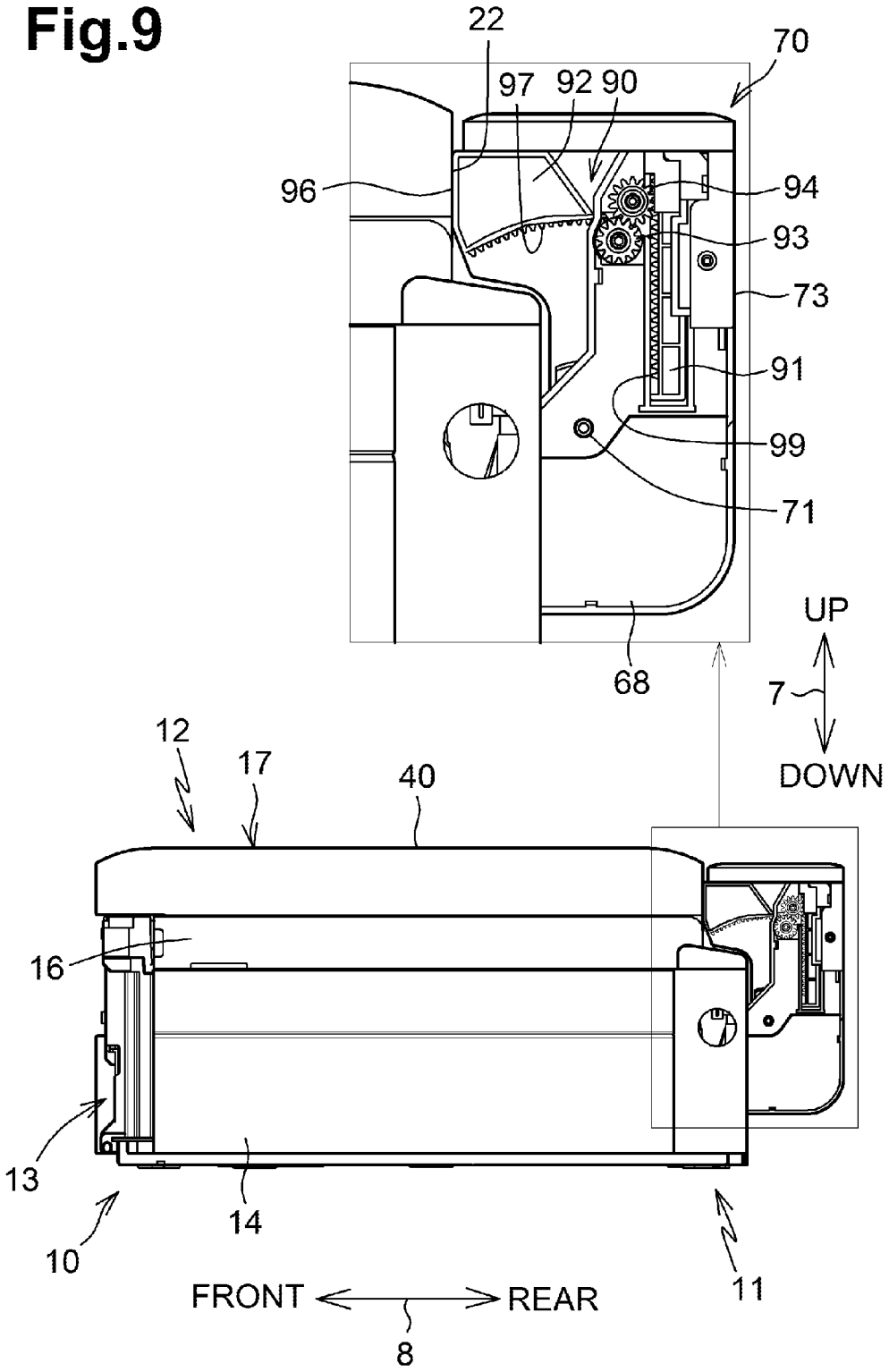
FIG. 9 is a side view depicting the interlock mechanism in the illustrative embodiment according to one or more aspects of the disclosure, wherein the document cover is located at the first position.

As depicted in FIGS. 1, 4, and 9, the tray cover 81 is configured to be located at a position where the tray cover 81 covers the sheet inlet 75 in the bypass tray 70 on the standing support plate 73 (e.g., the first state). In this state, the tray cover 81 extends toward the document cover 17 from the rotational axis and a proximal end of the tray cover 81 is located at a position lower than the upper surface of the document cover 17. The tray cover 81 is configured to cover the sheet inlet 75 completely or partially. For example, the tray cover 81 configured to cover the sheet inlet 75 completely may prevent or reduce an entry of dust and/or foreign matter via the sheet inlet 75 in the first state. For another example, the tray cover 81 configured to cover the sheet inlet 75 partially may prevent an accidental sheet insertion into the sheet inlet 75 in the first state when the bypass tray 70 is not used.

As depicted in FIG. 3, the tray cover 81 is configured to be located at a position where the tray cover 81 exposes the sheet inlet 75 in the bypass tray 70 on the tilting support plate 73 (e.g., a second state). In this state, the tray cover 81 extends obliquely upward to extend the support surface 74 of the support plate 73. A range in which the tray cover 81 pivots between the position where the tray cover 81 takes the first state and the position where the tray cover 81 takes the second state partially overlaps a range in which the document cover 17 pivots between the first position and the second position. While the document cover 17 pivots from the first position to the second position, a rear surface 22 of the document cover 17 comes into contact with the tray cover 81 that is in the first state.

An extension support portion 82 is pivotably disposed at a distal end of the tray cover 81. As depicted in FIG. 3, the extension support portion 82 is configured to pivot to a protruding position in which the extension support portion 82 protrudes from the distal end of the tray cover 81. In this state, the extension support portion 82 is configured to support trailing edge portions of one or more recording sheets protruding beyond the support surface 74. A user is allowed to pivot the tray cover 81 arbitrary. The tray cover 81 is configured to pivot between the position where the tray cover 81 takes the first state and the position where the tray cover 81 takes the second state regardless of whether the support plate 73 is in the standing position or in the tilting position.

[Interlock Mechanism 90]

The bypass tray 70 includes an interlock mechanism 90 that is pivotable about a rotational axis. The interlock mechanism 90 is configured to move a contact member 91 in a direction that the contact member 91 comes into contact with the tray cover 8 in synchronization with the movement of the document cover 17 from the first position to the second position. The interlock mechanism 90 is further configured to move the contact member 91 in a direction that contact member 91 moves away from the tray cover 81 in synchronization with the movement of the document cover 17 from the second position to the first position.

The interlock mechanism 90 is disposed at a left portion of the fixed portion 68 of the bypass tray 70 in the right-left direction 9. In other words, the interlock mechanism 90 or at least the contact member 91 are not disposed at a right portion of the fixed portion 68 in the right-left direction 9. With this configuration, as depicted in FIG. 8, the protruding document tray 37 does not interfere with the contact member 91. In the illustrative embodiment, a pivot member 95 that is similar to a pivot member 92 is disposed at the right portion of the fixed portion 68 in the right-left direction 9. Nevertheless, the pivot member 95 is disposed to have design balance between the right and left sides of the multifunction device 10, and therefore, the pivot member 95 does not function as the interlock mechanism 90.

Figure 7:
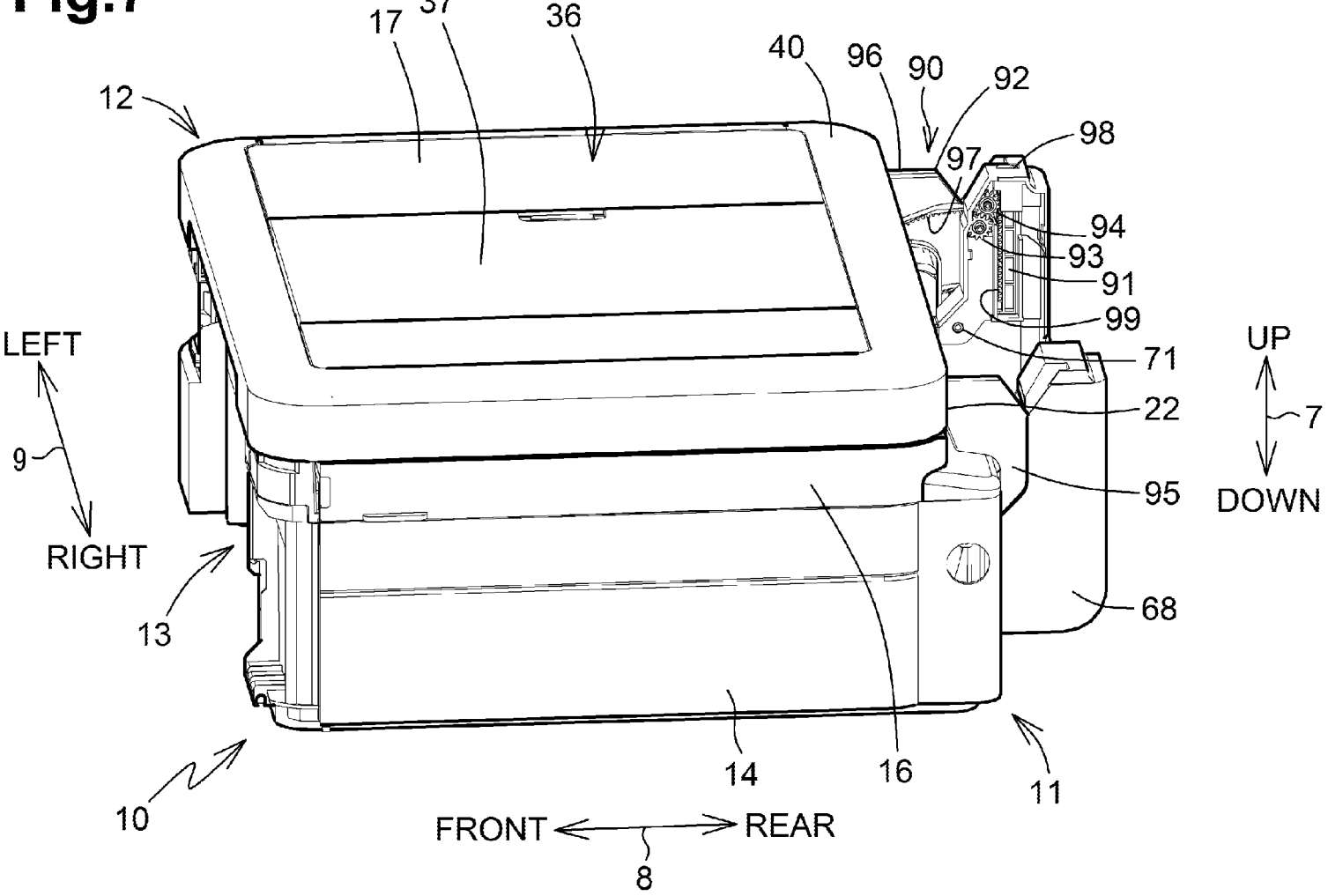
FIG. 7 is a perspective view depicting an interlock mechanism in the illustrative embodiment according to one or more aspects of the disclosure.

As depicted in FIG. 7, the interlock mechanism 90 includes the contact member 91, the pivot member 92, a two-level gear 93, and a pinion gear 94.

The pivot member 92 has a disc shape partially and becomes widen toward its distal end from its proximal end. The pivot member 92 is pivotably supported by a rotational shaft 71 such that the relatively-narrowed proximal end portion of the pivot member 92 protrudes from the fixed portion 68 in the right-left direction 9. The rotational shaft 71 is parallel to the rotational axis of the tray cover 81 and the rotational axis of the second housing, or document cover 17, and is disposed at a position lower than the rotational axis of the tray cover 81 in the up-down direction 7. Although not depicted in the drawings, a torsion coil spring is disposed on the rotational shaft 71 to urge the pivot member 92 toward the document cover 17. With this configuration, the pivot member 92 is retained at a position closer to the housing 16 while an external force is not applied on the pivot member 92. When an external force that pivots the pivot member 92 rearward against the urging force of the torsion coil spring is applied on the pivot member 92, the pivot member 92 pivots in a rearward direction that the pivot member 92 moves away from the housing 16.

The interlock mechanism 90 contacts the document cover 17 via a pivot member 92 that includes a contact portion 96 at its distal end portion. The contact portion 96 may face the document cover 17. The contact portion 96 is disposed at a position where the contact portion 96 is capable of contacting the rear surface 22 or an upper surface 40 of the document cover 17. The pivot member 92 includes a segment gear 97 at its distal end portion. The segment gear 97 protrudes toward the proximal end of the pivot member 92. The segment gear 97 is configured to rotate on the rotational shaft 71.

The fixed portion 68 includes the two-level gear 93 and the pinion gear 94 therein. The two-level gear 93 and the pinion gear 94 is supported so to be rotatable on respective axes extending along the right-left direction 9. The two-level gear 93 includes a gear that engages with the segment gear 97 and a gear that engages with the pinion gear 94, wherein these gears have a common axis. Power is transmitted to the pinion gear 94 from the segment gear 97 via the two-level gear 93.

The interlock mechanism 90 contacts the cover 81 via the contact member 91, which is disposed in the fixed portion 68. The contact member 91 illustrated in FIG. 10 has a rod-like shape. The contact member 91 is configured to slide along the up-down direction 7 from a position where the contact member 91 is located at the same level as the upper surface of the fixed portion 68 and is covered with the tray cover 81 in the second state. With the sliding of the contact member 91, the contact portion 98 that serves as an upper surface of the contact member 91 protrudes or retracts with respect to the upper surface of the fixed portion 68. The contact member 91 includes a rack gear 99 on a surface of its lower portion, wherein the surface of the lower portion of the contact member 91 faces the pinion gear 94. The rack gear 99 is in engagement with the pinion gear 94 to constitute a rack and pinion mechanism. The rotation of the pinion gear 94 is converted into the sliding of the contact member 91 via the rack gear 99. In a state where an external force is not applied on the pivot member 92, the contact portion 98 of the contact member 91 is retracted in the upper surface of the fixed portion 68.

[Interlock Operation Between Document Cover 17 and Tray Cover 81]

As depicted in FIGS. 1 and 9, in a state where the document cover 17 is closed in the scanner unit 12, that is, the document cover 17 is in the first position, the pivot member 92 of the interlock mechanism 90 is urged by the torsion coil spring and thus the contact portion 96 is in contact with the rear surface 22 of the document cover 17. Further, the contact portion 98 of the contact member 91 is retracted in the upper surface of the fixed portion 68. The bypass tray 70 is in the unused state, that is, the support plate 73 is in the standing position, and the tray cover 81 covers the sheet inlet 75.

Figure 10:
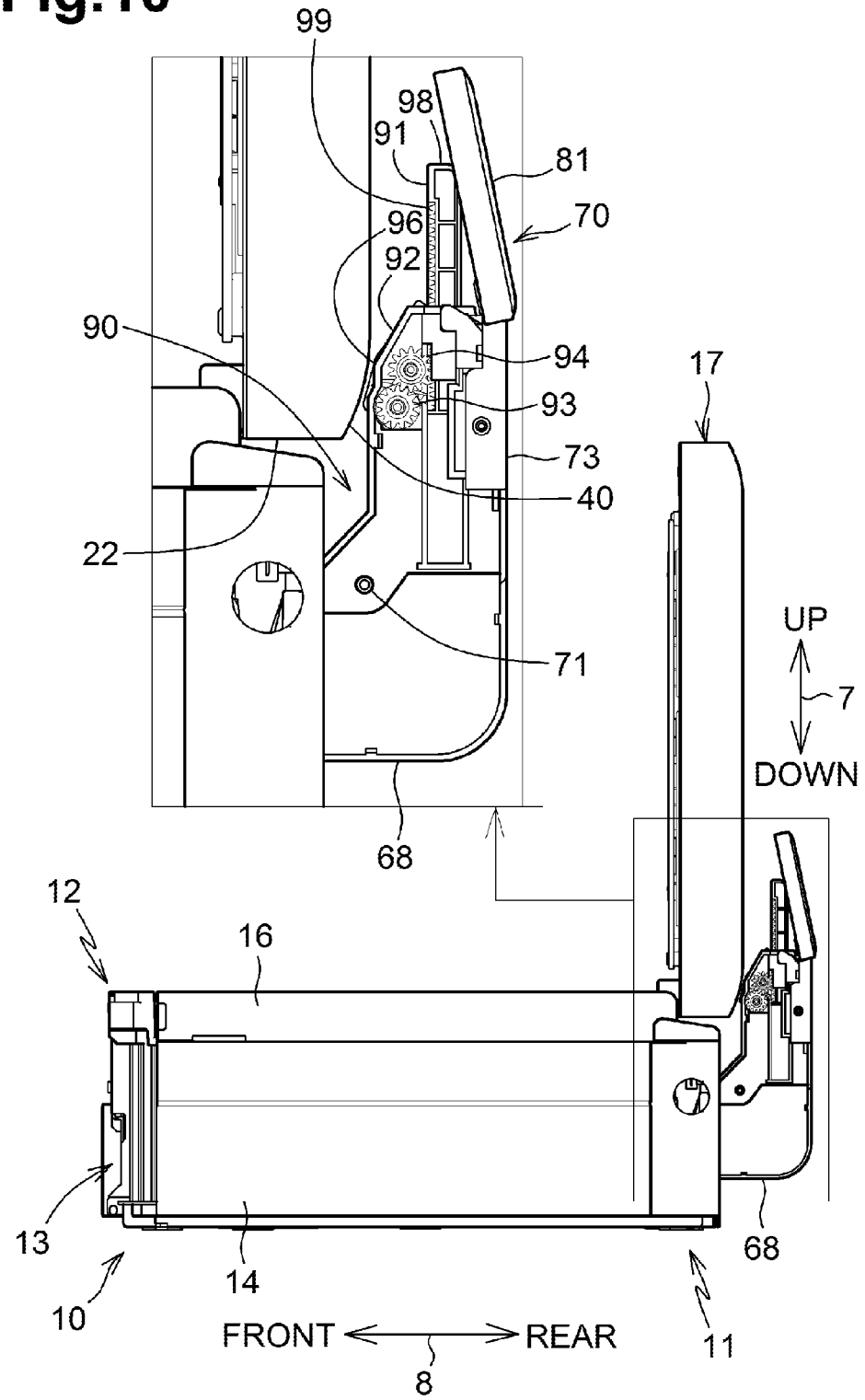
FIG. 10 is a side view depicting the interlock mechanism in the illustrative embodiment according to one or more aspects of the disclosure, wherein the document cover is located at the second position.

As depicted in FIGS. 2 and 10, in accordance with the movement of the document cover 17 to be opened, that is, in accordance with the pivoting of the document cover 17 to the second position, the rear surface 22 of the document cover 17 moves rearward to press the contact portion 96 of the pivot member 92, and thus, the contact portion 96 of the pivot member 92 moves rearward. Then, the pivot member 92 pivots rearward against the urging force of the torsion coil spring. This pivoting of the pivot member 92 is converted into the sliding of the contact member 91 via the segment gear 97, the two-level gear 93, the pinion gear 94, and the rack gear 99. This power transmission allows the contact member 91 to slide upward and thus the contact portion 98 protrudes from the upper surface of the fixed portion 68. After the contact portion 96 of the pivot member 92 reaches an upper end of the rear surface 22 of the document cover 17, the contact portion 96 is pressed by the upper surface 40 of the document cover 17 to move rearward.

The contact portion 98 protruding from the upper surface of the fixed portion 68 comes into contact with the tray cover 81 and pivots the tray cover 81 from the position where the tray cover 81 covers the sheet inlet 75 (e.g., the first state) toward the position where the tray cover 81 exposes the sheet inlet 75 (e.g., the second state). The contact member 91 pivots the tray cover 81 in a direction that the tray cover 81 moves away from the pivotable range of the document cover 17, that is, toward the position where the tray cover 81 takes the second state, before the rear surface 22 of the document cover 17 enters the pivotable range of the tray cover 81. Thus, during the pivoting of the document cover 17 to the second position, the rear surface 22 of the document cover 17 does not come into contact with the tray cover 81.

As depicted in FIGS. 2 and 10, as the document cover 17 pivots toward the first position from the second position, the upper surface 40 and the rear surface 22 of the document cover 17 move forward. In accordance with the forward movement of the upper surface 40 and the rear surface 22 of the document cover 17, the pivot member 92, which is urged by the torsion coil spring, pivots forward while the pivot member 92 contacts the contact portion 96 to one of the upper surface 40 and the rear surface 22. The rotation of the pivot member 92 is converted into the sliding of the contact member 91 via the segment gear 97, the two-level gear 93, the pinion gear 94, and the rack gear 99. This power transmission allows the contact member 91 to slide downward.

In accordance with the downward movement of the contact portion 98 of the contact member 91, the tray cover 81 pivots from the position where the tray cover 81 takes the second state to the position where the tray cover 81 takes the first state by its own weight. After the rear surface 22 of the document cover 17 moves to out of the pivotable range of the tray cover 81, the contact member 91 may pivot the tray cover 81 in a direction that the tray cover 81 approaches the pivotable range of the document cover 17, that is, toward the position where the tray cover 81 takes the first state. Then, as the contact portion 98 of the contact member 91 retracts in the upper surface of the fixed portion 68, the tray cover 81 becomes in the first state. As described above, the tray cover 81 becomes in the first state without contacting the document cover 17 while the document cover 17 pivots toward the first position.

Figure 12:
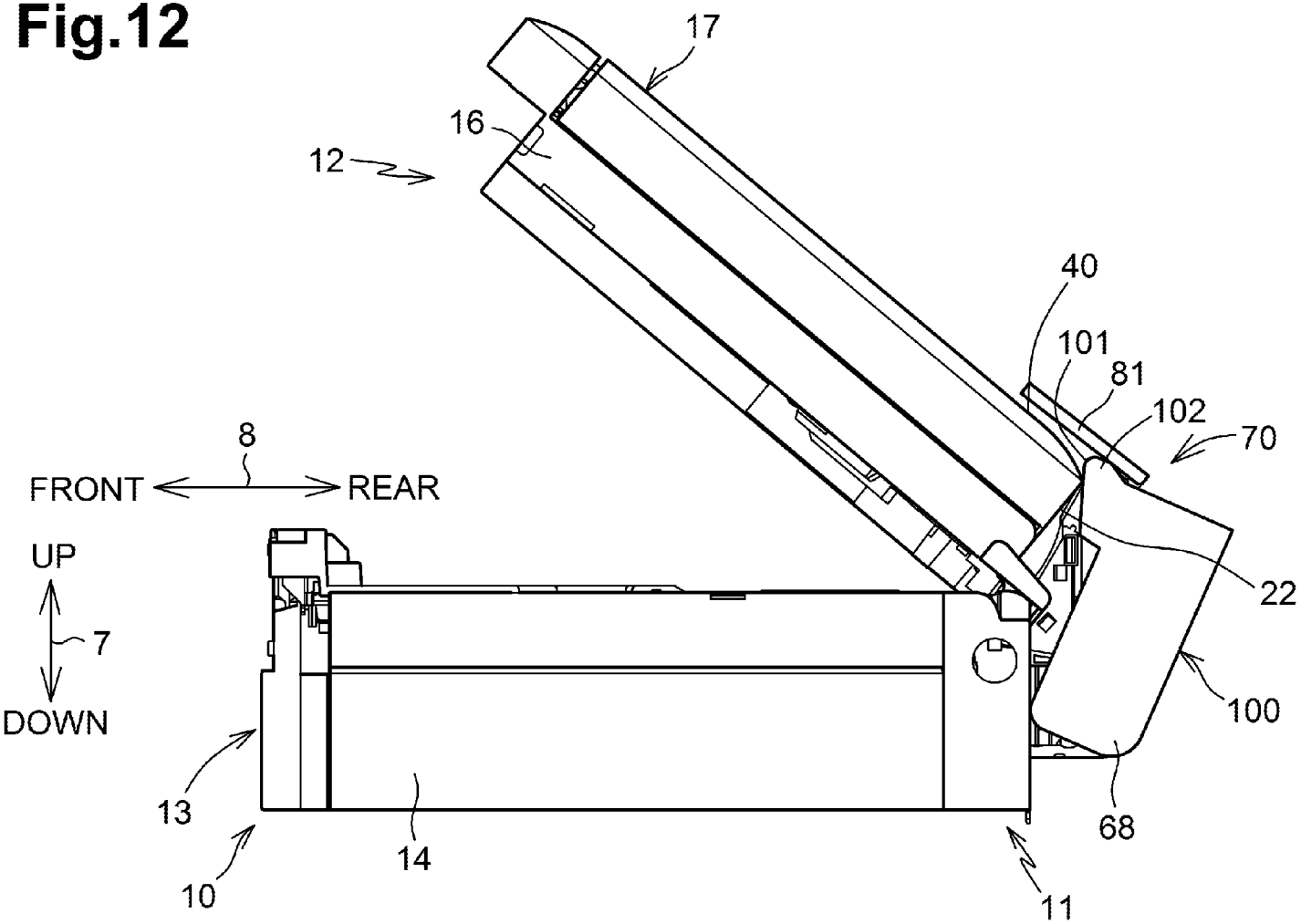
FIG. 12 is a side view depicting the multifunction device including the pivot member in the variation of the illustrative embodiment according to one or more aspects of the disclosure, wherein the document cover is located at the second position.

As depicted in FIG. 12 according to a variation of the illustrative embodiment, there is a case where the housing 16 is pivoted with respect to the housing 14 in order to, for example, maintain the printer unit 11. While the document cover 17 stays at the first position, the rear surface 22 of the document cover 17 comes into contact with the contact portion 96 of the pivot member 92 in accordance with the pivoting of the housing 16 with respect to the housing 14. Even when such a situation happens, similar to the situation described above, the interlock mechanism 90 pivots the tray cover 81 in the first state toward the position where the tray cover 81 takes the second state. Thus, such a configuration prevent or reduce the contact of the rear surface 22 of the document cover 17 to the tray cover 81.

[Operations in Printer Unit 11]

Hereinafter, an operation performed in the printer unit 11 in each case when using the feed tray 20 and when using the bypass tray 70 will be described.

In the case where the bypass tray 70 is not used, as depicted in FIG. 1, the support plate 73 is retained in the standing position. A projected area of the standing support plate 73 is smaller, and therefore, the multifunction device 10 requires a smaller space behind the multifunction device 10. The tray cover 81 takes the first state in which the tray cover 81 covers the sheet inlet 75 of the bypass tray 70. If there is enough space behind the multifunction device 10, the support plate 73 is maintained in the tilting position and the tray cover 81 is maintained in the second state even when the bypass tray 70 is not used.

In the case where the feed tray 20 is used, one or more recording sheets having a desired size are placed on the feed tray 20. More specifically, one or more recording sheets are supported by the feed tray 20 in a stacked manner. The feed tray 20 that supports the one or more recording sheets and has been inserted into the housing 14 via the opening 13 is positioned in the housing 14. In this state, the feed roller 25 is in contact with a topmost recording sheet of the one or more recording sheets placed on the feed tray 20. The printer unit 11 determines whether a recording sheet is fed from the feed tray 20 based on an user's input and print data.

Upon receipt of an instruction to start printing, the printer unit 11 drives the motor (not depicted) to rotate the feed roller 25, the first conveyor roller pair 54, and the second conveyor roller pair 55 at a predetermined timing. With the rotation of the feed roller 25, the topmost recording sheet is fed into the conveyance path 65 from the feed tray 20 and is guided through the curved path 65A of the conveyance path 65. Thus, the recording sheet reaches the first conveyor roller pair 54. Then, the recording sheet is further conveyed to the recording section 24 while being pinched by first conveyor roller pair 54, and a desired image is recorded on the recording sheet pinched by the first conveyor roller pair 54 by ejecting ink droplets from the recording head 39. The recording sheet on which the image has been recorded is discharged onto the discharge tray 21 by the second conveyor roller pair 55.

In the case where the bypass tray 70 is used, as depicted in FIG. 3, the support plate 73 is in the tilting position and the tray cover 81 is in the second state where the tray cover 81 exposes the sheet inlet 75 of the bypass tray 70.

One or more recording sheets having a desired size are placed on the bypass tray 70. More specifically, the one or more recording sheets are supported by the support surface 74 of the bypass tray 70 in a stacked manner. In this state, the feed roller 76 of the bypass tray 70 is in contact with a topmost recording sheet of the one or more recording sheets supported by the support surface 74.

Upon receipt of an instruction to start printing, the printer unit 11 drives the motor (not depicted) to rotate the feed roller 76, the first conveyor roller pair 54, and the second conveyor roller pair 55 at a predetermined timing. With the rotation of the feed roller 76, the topmost recording sheet is fed into the bypass 66 from the bypass tray 70. The recording sheet moves into the straight path 65B of the conveyance path 65 from the bypass 66 and then reaches the first conveyor roller pair 54. Meanwhile, the outer guide member 18 that defines the bypass 66 and the straight path 65B, the guide member 32, and the guide member 31 guides the recording sheet toward the first conveyor roller pair 54. Then, the recording sheet is further conveyed to the recording section 24 while being pinched by the first conveyor roller pair 54, and a desired image is recorded on the recording sheet pinched by the first conveyor roller pair 54 by ejecting ink droplets from the recording head 39. The recording sheet on which the image has been recorded is discharged onto the discharge tray 21 by the second conveyor roller pair 55.

Effects of Illustrative Embodiment

According to the illustrative embodiment, in accordance with the pivoting of the document cover 17 from the first position to the second position, the contact portion 98 of the contact member 91 moves in the direction that the contact portion 98 comes into contact with the tray cover 81 via the interlock mechanism 90. The tray cover 81 pivots from the position where the tray cover 81 covers the sheet inlet 75 to the position where the tray cover 81 exposes the sheet inlet 75 by the contact portion 98 that contacts the tray cover 81. Even when the pivotable range of the document cover 17 overlaps the pivotable range of the tray cover 81, this configuration prevents or reduces the contact of the document cover 17 to the tray cover 81 while the document cover 17 pivots to the second position. In accordance with the position change of the document cover 17 to the second position from the first position, the contact portion 98 of the contact member 91 moves in the direction that the contact portion 98 moves away from the tray cover 81 via the interlock mechanism 90. Thus, the tray cover 81 in the second state where the tray cover 81 exposes the sheet inlet 75 pivots to the position where the tray cover 81 takes the first state where the tray cover 81 covers the sheet inlet 75. Accordingly, there is implemented the multifunction device 10 that is reduced in size and includes the document cover 17 that changes its state and the tray cover 81 configured to close and expose the sheet inlet 75.

The bypass tray 70 is disposed behind the document cover 17 and the rotational axis of the document cover 17 is located at the position closer to the bypass tray 70, that is, at the back of the document cover 17. Therefore, when the document cover 17 is located at the second position, the user is allowed to access the platen glass 30 of the housing 16 from the front of the document cover 17. In addition, the tray cover 81 that is configured to pivot in synchronization with the pivoting of the document cover 17 does not pivot toward the user who is operating the document cover 17 from the front. A sheet is conveyed toward the front of the housing 14 from the bypass tray 70. Therefore, the user is allowed to access the sheet from the front of the housing 14 after the conveyance of the sheet is completed.

In the multifunction device 10 that includes the flatbed scanner that is relatively frequently used, the tray cover 81 of the bypass tray 70 is allowed to be disposed within the pivotable range of the document cover 17.

The contact member 91 of the interlock mechanism 90 is disposed at the left portion of the multifunction device 10 only. The left portion of the multifunction device 10 is opposite to the right portion of the multifunction device 10 in the right-left direction 9. The document tray 37 of the ADF 36 disposed at the document cover 17 is configured to protrude from the right portion of the multifunction device 10. Therefore, the range in which the contact member 91 slides does not overlap the range in which the document tray 37 moves in accordance with opening or closing of the document cover 17.

The bypass tray 70 includes the support plate 73 configured to pivot between the standing position and the tilting position. Therefore, the bypass tray 70 is brought into the standing position when the bypass tray 70 is not used, whereby the multifunction device 10 saves space.

The distal end of the tray cover 81 covering the sheet inlet 75 is located at the position lower than the upper surface of the document cover 17 located at the first position. This configuration accomplished a reduction in height of the multifunction device 10.

[Variations]

In the illustrative embodiment described above, the interlock mechanism 90 includes the contact member 91, the pivot member 92, the two-level gear 93, and the pinion gear 94. In other embodiments, for example, the interlock mechanism may be implemented with another configuration.

Figure 11:
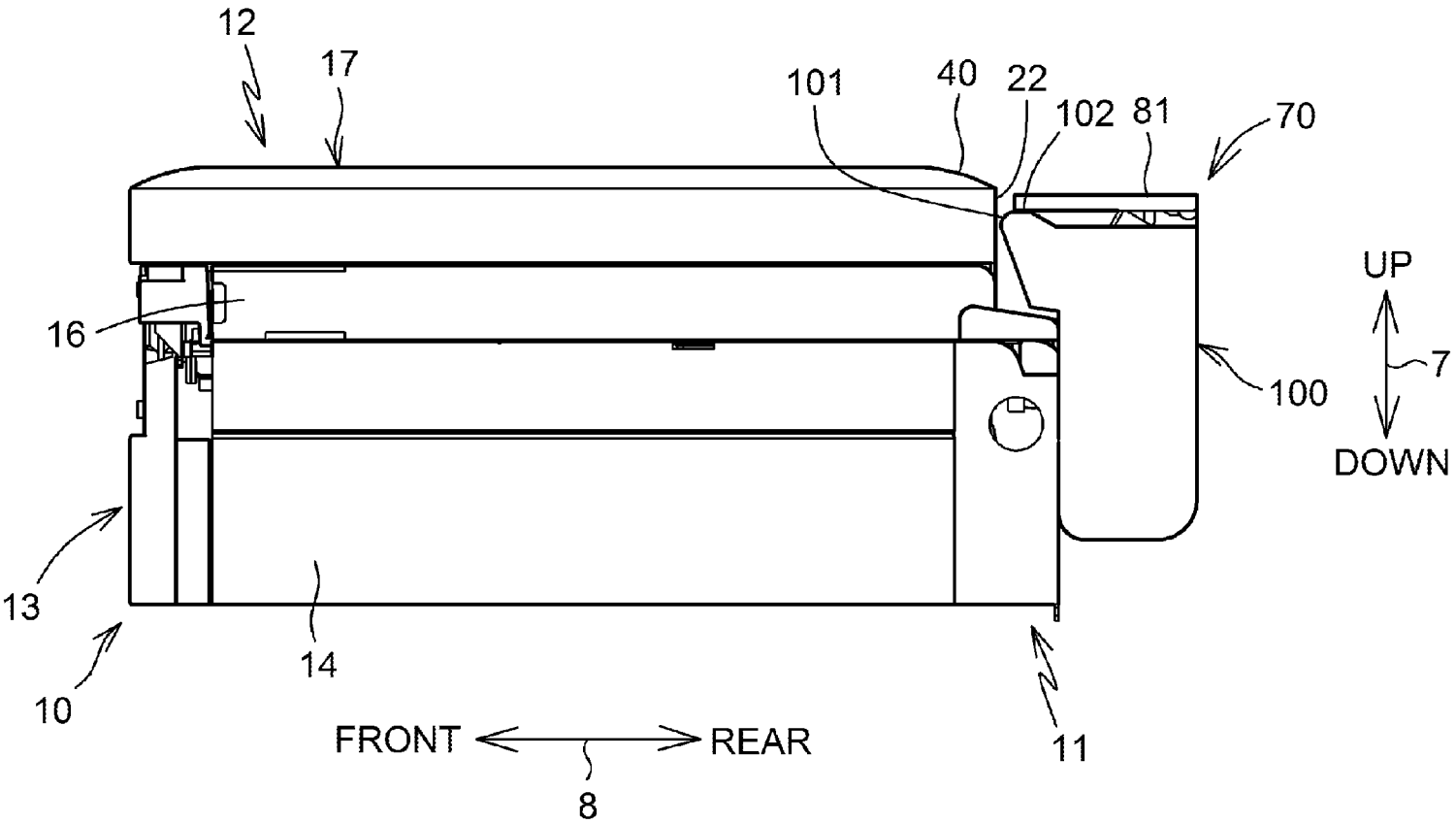
FIG. 11 is a side view depicting the multifunction device including a pivot member in a variation of the illustrative embodiment according to one or more aspects of the disclosure, wherein the document cover is located at the first position.

More specifically, as depicted in FIGS. 11 and 12, as the interlock mechanism, a pivot member 100 may be disposed at the fixed portion 68 of the bypass tray 70. The pivot member 100 may be configured to pivot on a rotational axis extending in parallel to the rotational axis of the document cover 17. The pivot member 100 may be disposed on each side of the bypass tray 70 in the right-left direction 9. Each pivot member 100 may include a contact portion 101 and a contact portion 102 at a distal end portion. The rear surface 22 of the document cover 17 may come into contact with the contact portion 101. The contact portion 102 may come into contact with the tray cover 81.

The pivot members 100 each may have a flat plate shape and may be disposed such that its surfaces each having the largest area face the right and the left, respectively, in the right-left direction 9. In each of the pivot members 100, the contact portion 101 and the contact portion 102 may be portions of a peripheral surface in a thickness direction extending along the right-left direction 9. The contact portion 101 may be disposed facing the rear surface 22 of the document cover 17. The contact portion 102 may be disposed facing the distal end of the lower surface of the tray cover 81. Although not depicted in the drawings, the pivot members 100 may be urged by torsion coil springs, respectively, toward the rear surface 22 of the document cover 17, that is, toward the front.

As depicted in FIG. 11, in a state where the document cover 17 is closed, that is, the document cover 17 is in the first position, in the scanner unit 12, the pivot members 100 may be urged by the respective torsion coil springs and thus the contact portions 101 may be in contact with or may be located closer to the rear surface 22 of the document cover 17. The tray cover 81 may cover the sheet inlet 75 while the contact portions 102 of the pivot members 100 are disposed closer to the distal end of the tray cover 81 than the proximal end of the tray cover 81 and may be in contact with the distal end portion of the tray cover 81.

As depicted in FIG. 12, as the document cover 17 pivots in accordance with the pivoting of the housing 16 with respect to the housing 14, that is, the document cover 17 pivots toward the second position, the rear surface 22 of the document cover 17 may move rearward and one of the rear surface 22 and the upper surface 40 may press the contact portions 101 of the pivot members 100. Thus, the contact portions 101 of the pivot members 100 may move rearward. Therefore, the pivot members 100 may pivot rearward against the urging forces of the torsion coil springs. In accordance with the pivoting of the pivot members 100, the contact portions 102 may move about the rotational shafts of the pivot members 100, respectively, to slide across the tray cover 81 from the distal end portion to the proximal end portion. Thus, the tray cover 81 covering the sheet inlet 75 (e.g., the first state) may pivot toward the position where the tray cover 81 exposes the sheet inlet 75 (e.g., the second state). The pivot members 100 configured as described above may also provide the same effects as those that the illustrative embodiment provide. FIG. 12 illustrates a situation in which the document cover 17 pivots together with the housing 16 with respect to the housing 14. When only the document cover 17 pivots with respect to the housing 16, the same effects obtained by the illustrative embodiment may be obtained.

In the illustrative embodiment and the variations, the document cover 17 pivots with respect to the housing 16 and the housing 16 pivots with respect to the housing 14. Nevertheless, in other embodiments, for example, the housing 16 may be unnecessarily required to be configured to pivot with respect to the housing 14.

In the illustrative embodiment and variations, the multifunction device 10 including the scanner unit 12 is taken as the example of the image recording device. Nevertheless, in other embodiments, for example, the image recording device might not be required to include the scanner unit 12. Although such an image recording device does not include the document cover 17 as the second housing, for example, the image recording device includes the pivotable cover configured to pivot with respect to the housing 14 similar to the housing 16, as the second housing, and the pivotable cover is configured to pivot with respect to the housing 14 as the first housing in order to maintain the printer unit 11 or in order to replace an ink cartridge. This configuration may also provide the same effects as those that the illustrative embodiment provide.

What is claimed is:

1. A sheet conveyor device comprising:

a first housing having a sheet conveyance path;

a second housing pivotably disposed above the first housing and movable between a first position at which the second housing is adjacent to an upper side of the first housing and a second position at which the second housing is angled relative to the upper side of the first housing;

a sheet support member connected to the first housing, the sheet support member having a sheet inlet communicating with the conveyance path and a sheet support plate;

a cover disposed on the sheet support member to pivot about a first rotational axis between a first state and a second state; and an interlock mechanism pivotable about a second rotational axis that is parallel to the first rotational axis in response to movement of the second housing between the first position and the second position to move the cover between the first state and the second state;

wherein the support plate is movable between a standing position at which the support plate stands generally parallel to a side surface of the first housing and an angled position relative to the side surface of the first housing, and wherein the cover is disposed at the support plate.

2. The sheet conveyor device according to claim 1, wherein the interlock mechanism comprises a contact portion movable in a first direction where the contact portion comes into contact with the cover and in a second direction where the contact portion moves away from the cover, wherein the contact portion changes the cover from the first state to the second state by moving while the contact portion is in contact with the cover having the first state, and wherein the interlock mechanism is further configured to:

move the contact portion in the first direction in synchronization with movement of the second housing from the first position to the second position; and move the contact portion in the second direction in synchronization with the movement of the second housing from the second position to the first position.

3. The sheet conveyor device according to claim 1, wherein the second housing pivots about a third rotational axis parallel to the first and second pivot axes, and wherein a distal end of the cover is located between the third rotational axis and an upper side of the second housing when the cover is in the first state.

4. The sheet conveyor device according to claim 1, wherein the sheet support member is disposed on a first side surface of the first housing.

5. The sheet conveyor device according to claim 2, wherein the first housing further comprises a scanner unit comprising a platen configured to support a document, wherein the scanner unit is configured to read an image from the document supported by the platen, and wherein the second housing includes a document cover configured to cover the platen.

6. The sheet conveyor device according to claim 5, wherein the contact portion is slidable between a protrude position at which the contact portion protrudes from an upper surface of the sheet support member and a retracted position at which the contact portion is retracted in the upper surface of the sheet support member.

7. The sheet conveyor device according to claim 6, wherein:

the contact portion is disposed at a first side of the sheet support member;

the document cover comprises an automatic document feeder configured to feed a document to the platen that defines a first plane;

the automatic document feeder comprises a document tray configured to pivot between a first position wherein the document tray defines a second plane generally parallel to the first plane, and a second position where the document tray protrudes from the document cover;

a rotational shaft of the document tray extends a direction orthogonal to the first rotational axis, and in the second position, the document tray is situated adjacent a second side of the sheet support member opposite the first side of the sheet support member.

8. The sheet conveyor device according to claim 1, wherein a distal end of the cover is located lower than an upper surface of the second housing when the cover is in the first state.

9. The sheet conveyor device according to claim 2, wherein the interlock mechanism further comprises:

a pivot member configured to pivot on the second rotational axis when contacted by the second housing as the second housing pivots from the first position to the second position;

a contact member comprising the contact portion and slidably connected to the sheet support member, and a rack and pinion mechanism configured to convert the pivoting of the pivot member into the sliding of the contact member in response to movement of the second housing.

10. The sheet conveyor device according to claim 2, wherein the interlock mechanism further comprises:

a pivot member configured to pivot on the second rotational axis when contacted by the second housing as the second housing pivots from the first position to the second position; and the pivot member includes the contact portion.

11. A sheet conveyor device comprising:

a first housing having a sheet conveyance path;

a second housing disposed above the first housing and pivotable about a first rotational axis between a first position and a second position, the second housing having a first surface and a second surface opposite the first surface, the second surface being adjacent the first housing when the second housing is in the first position;

a sheet support member connected to the first housing, the sheet support member having a sheet inlet communicating with the conveyance path;

a cover disposed on the sheet support member and situated below the first surface of the second housing, the cover being movable between a first state and a second state, wherein the cover does not overlap the second housing; and an interlock mechanism contacting the second housing and the cover to move the cover between the first state and the second state in response to movement of the second housing between the first position and the second position.

12. The sheet conveyor device according to claim 11, wherein:

the sheet support member further comprises a sheet support plate;

the support plate is movable between a standing position at which the support plate stands generally parallel to the side surface of the first housing and an angled position relative to the side surface of the first housing, and the cover is disposed at the support plate.

13. The sheet conveyor device according to claim 11, wherein the cover is laterally spaced from an end surface the second housing.

14. The sheet conveyor device according to claim 1, wherein the cover does not overlap the second housing.

15. The sheet conveyor device according to claim 11, wherein:

the cover is disposed on the sheet support member to pivot about a first rotational axis between the first state and the second state; and the interlock mechanism is pivotable about a second rotational axis that is parallel to the first rotational axis in response to movement of the second housing between the first position and the second position to move the cover between the first state and the second state.

16. The sheet conveyor device according to claim 11, wherein the interlock mechanism further comprises:

a pivot member configured to pivot on the second rotational axis when contacted by the second housing as the second housing pivots from the first position to the second position;

a contact member having a contact portion and slidably connected to the sheet support member, and a rack and pinion mechanism configured to convert the pivoting of the pivot member into the sliding of the contact member in response to movement of the second housing such that the contact portion is movable in a first direction where the contact portion comes into contact with the cover to move the cover from the first state to the second state in response to the second housing moving from the first position to the second position, and in a second direction where the contact portion moves away from the cover to move the cover from the second state to the first state in response to the second housing moving from the second position to the first position.

17. The sheet conveyor device according to claim 11, wherein the interlock mechanism further comprises:

a pivot member configured to pivot when contacted by the second housing as the second housing pivots between the first position to the second position, such that the pivot member pivots in a first direction and contacts the cover to move the cover from the first state to the second state in response to the second housing moving from the first position to the second position, and in a second direction where the pivot member moves away from the cover to move the cover from the second state to the first state in response to the second housing moving from the second position to the first position.

18. An image recording device comprising:

a first housing having a conveyance path;

a recording portion disposed along the conveyance path to record an image on a sheet in the conveyance path;

a second housing pivotably disposed above the first housing and movable between a first position at which the second housing is adjacent to an upper side of the first housing and a second position at which the second housing is angled relative to the upper side of the first housing;

a sheet support member connected to the first housing, the sheet support member having a sheet inlet communicating with the conveyance path;

a cover disposed on the sheet support member to pivot about a first rotational axis between a first state and a second state;

an interlock mechanism pivotable about a second rotational axis that is parallel to the first rotational axis in response to movement of the second housing between the first position and the second position to move the cover between the first state and the second state; and a scanner unit disposed in the first housing.

* * * * *